US006684981B2

(12) United States Patent
Stucky et al.

(10) Patent No.: US 6,684,981 B2
(45) Date of Patent: Feb. 3, 2004

(54) ELEVATOR LOAD BEARING ASSEMBLY HAVING A FERROMAGNETIC ELEMENT THAT PROVIDES AN INDICATION OF LOCAL STRAIN

(75) Inventors: Paul A. Stucky, Vernon, CT (US); Neil R. Baldwin, Manchester, CT (US)

(73) Assignee: Otis Elevator Co., Farmington, CT (US)

( * ) Notice: Subject to any disclaimer, the term of this patent is extended or adjusted under 35 U.S.C. 154(b) by 0 days.

(21) Appl. No.: 10/406,146

(22) Filed: Apr. 3, 2003

(65) Prior Publication Data

US 2003/0205434 A1 Nov. 6, 2003

Related U.S. Application Data

(63) Continuation of application No. 10/025,327, filed on Dec. 19, 2001, now abandoned, which is a continuation-in-part of application No. 09/970,451, filed on Oct. 3, 2001, now abandoned.

(51) Int. Cl.[7] ..... B66B 1/34

(52) U.S. Cl. ..... 187/393; 73/158; 73/862.56

(58) Field of Search ..... 187/391, 393, 187/414; 73/158, 862.381, 862.391, 862.471, 862.473, 862.56; 324/209

(56) References Cited

U.S. PATENT DOCUMENTS

| | | | |
|---|---|---|---|
| 4,427,095 | A | 1/1984 | Payne et al. |
| 4,602,476 | A | 7/1986 | Riggs et al. |
| 5,015,859 | A | 5/1991 | Uejio |
| 5,834,942 | A | 11/1998 | De Angelis |
| 5,890,564 | A | 4/1999 | Olsen et al. |
| 5,992,574 | A | 11/1999 | Olsen et al. |
| 6,073,728 | A | 6/2000 | Olsen et al. |
| 6,080,982 | A | 6/2000 | Cohen |
| 6,247,359 | B1 | 6/2001 | De Angelis |
| 6,289,742 | B1 | 9/2001 | De Angelis |

FOREIGN PATENT DOCUMENTS

| | | |
|---|---|---|
| DE | 303677 | 2/1918 |
| DE | 2 159995 | 6/1973 |
| EP | 0 103 162 A2 | 3/1984 |
| FR | 2 410 077 | 6/1979 |
| FR | 2676814 | 11/1992 |
| GB | 2 152 088 A | 7/1985 |
| JP | 02056397 A | 2/1990 |
| JP | 06183662 A | 7/1994 |
| WO | WO 00/58706 | 10/2000 |

OTHER PUBLICATIONS

International Search Report mailed Feb. 20, 2003.
International Search Report mailed Jan. 16, 2003.

*Primary Examiner*—Jonathan Salata
(74) *Attorney, Agent, or Firm*—Carlson, Gaskey & Olds

(57) ABSTRACT

An elevator load bearing assembly, such as a polymer cord, reinforced belt, includes at least one element of a ferromagnetic material associated with each cord that comprises one or more non-ferromagnetic materials. The ferromagnetic element is associated with the cord such that a physical characteristic of the ferromagnetic element changes responsive to strain on the non-ferromagnetic fibers. In one example, the ferromagnetic element is a steel wire that breaks in areas that are strained, caused by bending fatigue, for example. Detecting a number of changes (i.e., breaks) in the ferromagnetic element along the length of the load bearing assembly provides an indication of the belt condition.

14 Claims, 2 Drawing Sheets

ELEVATOR LOAD BEARING ASSEMBLY HAVING A FERROMAGNETIC ELEMENT THAT PROVIDES AN INDICATION OF LOCAL STRAIN

CROSS REFERENCE TO RELATED APPLICATION

This application is a continuation of Ser. No. 10/025,327, which was filed on Dec. 19, 2001, now abandoned, which is a continuation-in-part of Ser. No. 09/970,451, which was filed on Oct. 3, 2001, now abandoned.

BACKGROUND OF THE INVENTION

This invention generally relates to load bearing assemblies for elevator systems. More particularly, this invention relates to an arrangement for readily detecting localized strain in an elevator load bearing assembly.

Elevator systems typically include a cab and counterweight that are coupled together using an elongated load bearing member. Typical load bearing members include steel ropes and, more recently, synthetic ropes and multi-element ropes such as polymer coated, steel or synthetic cord reinforced belts. Synthetic ropes and polymer coated, synthetic cord reinforced belts are particularly attractive for elevator applications due to their greater strength-to-weight ratio compared with steel ropes or belts.

Inspecting a load bearing member in an elevator system has been accomplished in several ways. With conventional steel roping, a manual, visual inspection of the rope allows the technician to determine when particular strands of the steel rope are frayed, broken or otherwise worn. This inspection method is limited, however, to the exterior portions of the rope and does not provide any indication of the condition of interior strands of the rope. Additionally, a visual inspection method is somewhat difficult and time consuming and does not always permit complete inspection of the entire length of the load bearing arrangement.

There are similar limitations on using visual inspection techniques on newer ropes. For example, the polymer coated, polymer cord reinforced belts do not permit visual inspection because of the coating that is typically applied over the cords, which are made up of strands of polymer material. Several advances have been proposed for facilitating inspection of such load bearing arrangements. One example is shown in U.S. Pat. No. 5,834,942 where at least one carbon fiber is included in the load bearing member. An electric current is passed through the fiber. By measuring an electrical voltage across that fiber, a determination is made regarding the condition of the load bearing member. This proposal is limited, however, in that it does not provide any information regarding locations of maximum strain along the length of the load bearing member. Moreover, there is no way of guaranteeing that a loss of conductivity through the carbon fiber is directly correlated to strain or damage to the load bearing member. Another shortcoming of such an arrangement is that there is no qualitative information regarding degradation of the load bearing member over time.

There is a need for improved arrangements and methods for determining the condition of load bearing members in elevator assemblies. This invention provides a unique solution to that problem.

SUMMARY OF THE INVENTION

In general terms, this invention is a load bearing assembly for use in an elevator system. The inventive arrangement includes a plurality of non-ferromagnetic fibers arranged into at least one cord. At least one ferromagnetic element is associated with the cord. The ferromagnetic element is situated such that a physical characteristic of the ferromagnetic element changes responsive to strain on the non-ferromagnetic fibers. Such a change or changes in the ferromagnetic element can be detected. The ferromagnetic element, therefore, provides an indication of a condition of the assembly.

In one example, the ferromagnetic element breaks responsive to excessive strain on the non-ferromagnetic fibers. The breaks in the ferromagnetic element correspond to locations of the non-ferromagnetic elements that are strained. The ferromagnetic element preferably is chosen so that it breaks responsive to localized bending fatigue in the load bearing assembly.

A method of determining the condition of a load bearing assembly according to this invention includes arranging a ferromagnetic element in a selected relationship with a cord, which comprises a plurality of non-ferromagnetic fibers. The ferromagnetic element preferably is positioned in a selected relationship with the cord such that a physical characteristic of the ferromagnetic element changes responsive to localized strain on the non-ferromagnetic fibers. By determining a number of changes in the physical condition of the ferromagnetic element along the length of the assembly, a condition of the assembly is determined.

In one example, the method includes determining a number of breaks in the ferromagnetic element. By locating the breaks and comparing the number of breaks to predetermined selection criteria, the condition of the assembly can be determined to make a decision regarding the condition of the assembly to determine whether repair or replacement is needed.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
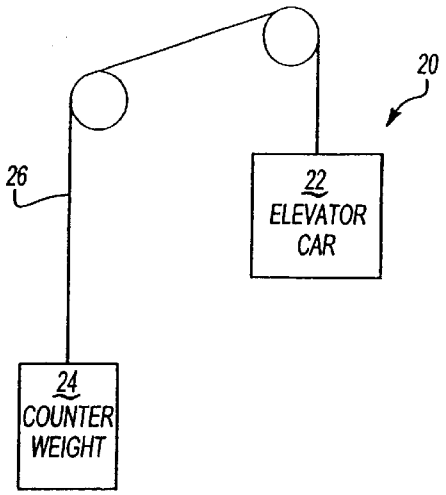
FIG. 1 schematically illustrates an elevator system.

FIG. 1 schematically shows an exemplary elevator system 20 that includes a cab 22 and a counterweight 24. A load bearing assembly 26 couples the cab 22 and counterweight 24 together so that the cab 22 can be moved between landings in a building, for example, in a conventional fashion.

The load bearing assembly 26 may take a variety of forms. One example is a flat belt containing polymer reinforced strands. Other examples include synthetic ropes and multi-element ropes. This invention is not limited to "belts" in the strictest sense. A flat belt is used as one example of a load bearing assembly designed according to this invention. Therefore, any reference to a "belt" within this description is not intended to be limiting in any sense.

Figure 2:
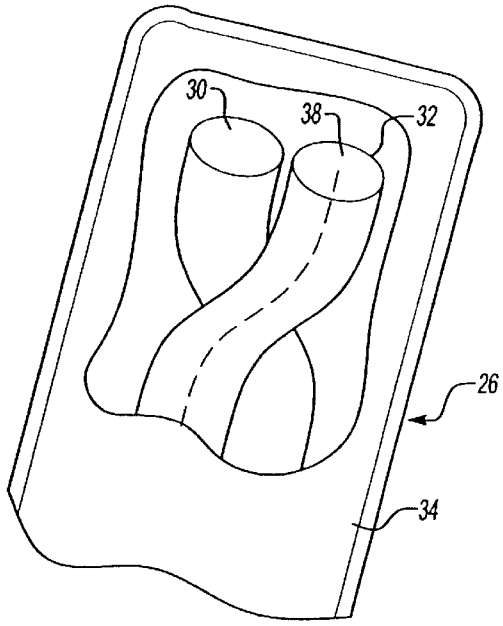
FIG. 2 schematically illustrates an exemplary load bearing assembly designed according to an embodiment of this invention.

The example load bearing assembly 26 shown in FIG. 2 includes a plurality of strands 30 that are wound together in a known manner to form at least one cord 32. A number of cords preferably are aligned parallel to each other and a longitudinal axis of the belt. A single cord is shown in FIG. 2 for discussion purposes. A non-ferromagnetic, polymer material preferably is used to form the strands 30. The illustrated strands are coated with a jacket 34, which protects the strands from wear and provides friction characteristics for driving the elevator system components as needed. This invention is not limited to coated belt arrangements.

At least one ferromagnetic element 38 preferably is associated with the cord 32. In the example of FIG. 2, the ferromagnetic element 38 is integrally placed within one of the strands 30 of the cord 32. There are a variety of ways of associating a ferromagnetic element 38 with a cord comprised of non-ferromagnetic fibers within the scope of this invention.

Figure 3:
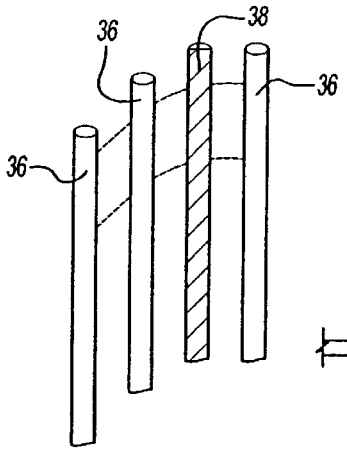
FIG. 3 schematically illustrates selected portions of the load bearing assembly of FIG. 2.

Referring to FIG. 3, a ferromagnetic element 38 is illustrated along with a plurality of non-ferromagnetic fibers 36 that are wound together in a conventional fashion to form a cord. A helical winding arrangement, as known in the art, provides the desired structural characteristics of the strands and the cord.

The ferromagnetic element 38 preferably is chosen to have physical characteristics that will not alter the performance of the load bearing assembly or interfere with the integrity of the assembly provided by the non-ferromagnetic fibers. In one example, a steel wire having an outside dimension that is similar to an outside dimension of the non-ferromagnetic fibers is used as the ferromagnetic element 38. The wire may be coated, depending on the needs of a particular situation.

The ferromagnetic element 38 is associated with the cord 32 such that strain on the non-ferromagnetic fibers of the assembly causes a corresponding change in a physical characteristic of the ferromagnetic element. In one example, the ferromagnetic element breaks responsive to bending fatigue experienced by the non-ferromagnetic fibers. In another example, the cross sectional dimension of the ferromagnetic element is reduced in locations where the non-ferromagnetic fibers are strained. By providing a ferromagnetic element that is altered in locations corresponding to strained fibers of the assembly, the ferromagnetic element 38 provides the ability to utilize monitoring equipment otherwise known in the art to make a determination regarding the condition of the assembly 26.

Figure 4:
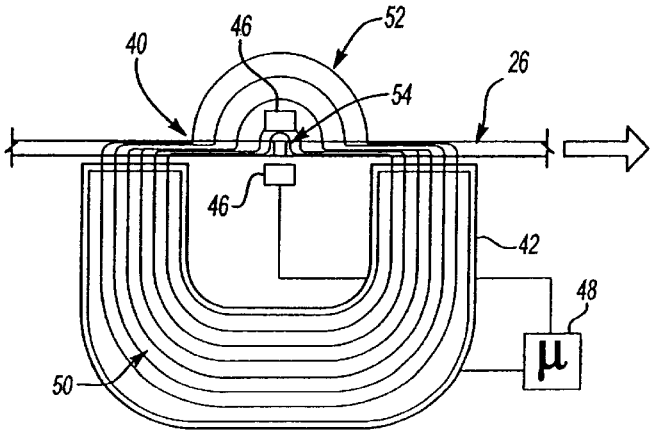
FIG. 4 schematically illustrates a monitoring device and technique useful with an embodiment of this invention.

In one example, a magnetic flux leakage technique is used to determine the number of breaks or other changes in the ferromagnetic element 38 along the length of the assembly 26. An example arrangement utilizing this technique is schematically illustrated in FIG. 4.

A monitoring device 40 includes a permanent magnet 42 and a pair of Hall effect sensors 46. A permanent magnet 42 creates a magnetic field as is schematically shown by the magnetic flux lines 50 in FIG. 4. As the assembly 26 moves relative to the monitoring device 40, physical changes in the ferromagnetic element 38 cause interruptions in the magnetic flux as schematically shown by the flux lines 52. A break in the ferromagnetic element 38 is schematically illustrated at 54. When the break 54 passes the Hall effect sensors 46 (as the belt moves relative to the monitoring device 40), an output is generated indicating the presence of the break 54. The controller 48 preferably is programmed to communicate with the sensors 46 and to record data indicating the number of detected breaks and information regarding the location of the breaks in the assembly 26.

More details regarding magnetic flux leakage techniques for detecting breaks or other physical changes in the ferromagnetic element 38 can be appreciated from the published PCT application WO 00/58706, published on Oct. 5, 2000, which is commonly owned with this application. The teachings of that application are incorporated by reference into this description.

The non-ferromagnetic material used to form the structural, load bearing cords of the load bearing member assembly can be any one or more of a variety of commercially available materials. The structural material of the load bearing member may be, for example, PBO, which is sold under the trade name Zylon; liquid crystal polymers such as a polyester-polyarylate, which is sold under the trade name Vectran; p-type aramids such as those sold under the trade names Kevlar, Technora and Twaron; or an ultra-high molecular weight polyethylene, an example of which is sold under the trade name Spectra; and nylon. Given this description and the known properties of such available materials, those skilled in the art will be able to select appropriate materials to meet the needs of their particular situation.

Figure 5:
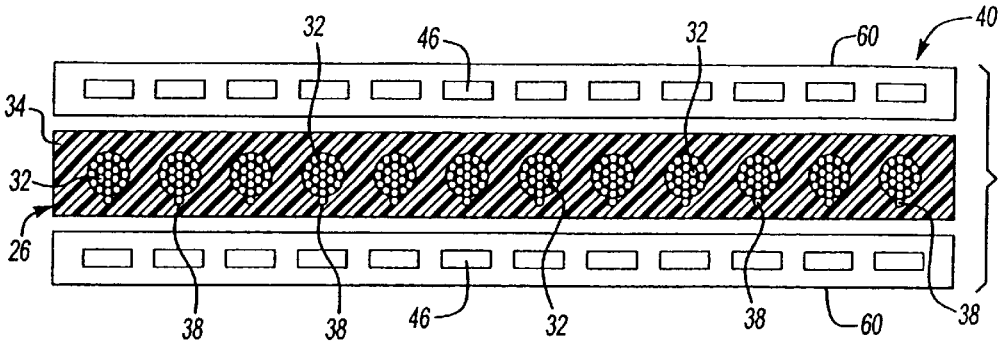
FIG. 5 schematically illustrates, in partial cross section, another example load bearing assembly designed according to an embodiment of this invention.

Another example is shown in FIG. 5. In this example, a plurality of cords 32 are aligned along the length of the load bearing assembly 26. Each of the cords 32 comprise a plurality of non-ferromagnetic fibers 36 that are wound together in a desired manner, such as in a known helical arrangement. The cords 32 are coated with an elastomeric jacket 34. In one example, the jacket 34 comprises polyurethane. Such coatings or jackets are known in the art.

There are a variety of ways to incorporate the second material element into the load bearing member assembly. The example of FIG. 5 includes a plurality of cords 32 supported within a single jacket 34 having a desired spacing between the cords across the width of the assembly 26. A ferromagnetic element 38 preferably is associated with each of the cords 32. The ferromagnetic elements 38 are supported within the jacket 34 in a selected position relative to each cord. In this example, the ferromagnetic elements 38 are supported immediately adjacent to the cords extending parallel to an axis of a respective cord 32. In this example, the ferromagnetic elements 38 are not integrated as part of the cords 32.

The example of FIG. 5 schematically shows selected portions of a monitoring device 40 having a plurality of Hall effect sensors 46 that are positioned to detect physical changes in the ferromagnetic elements 38 as the assembly 26 moves relative to the monitoring device 40. A permanent magnet is not illustrated in FIG. 5 for simplicity.

Figure 6:
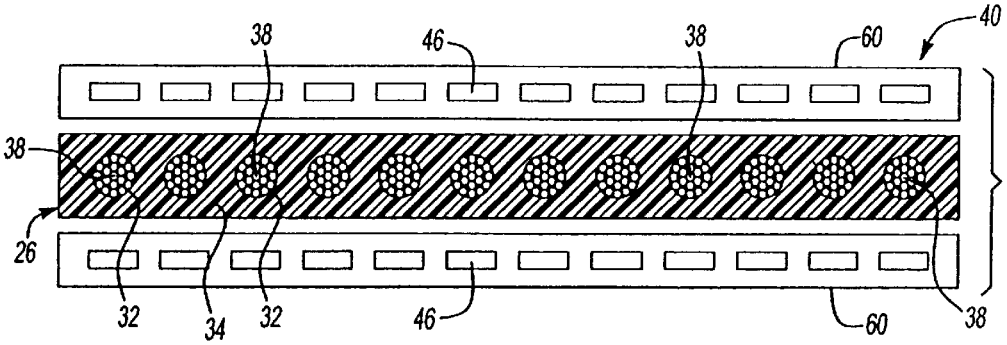
FIG. 6 schematically illustrates an alternative arrangement designed according to an embodiment of this invention.

The example of FIG. 6 includes integrating the ferromagnetic element 38 into the cords 32 of the load bearing assembly 26. In this example, the ferromagnetic elements 38 are at the center of each cord.

As the non-ferromagnetic fibers 36 are subjected to strain caused by such factors as bending fatigue, a physical characteristic of the ferromagnetic element 38 changes in the regions where the assembly is strained. Example physical characteristics that change include the continuity of the ferromagnetic element 38. In other words, the ferromagnetic element 38 in some examples will break responsive to bending fatigue or other strain on the non-ferromagnetic fibers 36. In another example, the physical, cross-sectional dimension of the ferromagnetic element 38 will change as the ferromagnetic element 38 is stretched (but not quite broken) in a region that undergoes strain.

Other physical characteristics may be monitored to determine where the assembly 26 has been strained. Breaks in the ferromagnetic element 38 (or portions with a reduced cross-section) provide a detectable change that can be monitored using known magnetic flux leakage techniques, for example. Other physical characteristic changes in the ferromagnetic element may be used, depending on the monitoring technique chosen for a particular situation. Those skilled in the art who have the benefit of this description will be able to make appropriate selections for their particular situation.

A method of this invention preferably includes predetermining correlating factors between a detected number of physical changes (i.e., breaks or areas of reduced cross section) in the ferromagnetic element and the condition of the assembly 26. For example, known testing devices and techniques can be used to subject the assembly 26 to desired amounts of strain to simulate known amounts of bending fatigue. The number of breaks or other physical changes in the ferromagnetic element 38 for a particular embodiment preferably are monitored at different stages of the testing. By correlating the number of changes with the known belt conditions at various stages during testing, comparative data is assembled and utilized to provide correlating factors so that field measurements of belts and service are useable to make a determination regarding actual belt condition.

For example, a belt section having a loss of belt breaking strength as derived from known bending fatigue tests can be utilized to provide a sample of a load bearing assembly that may not be fit for continued operation. The corresponding number of observed changes in the physical characteristic (i.e., cross-sectional dimension or continuity) of the ferromagnetic element within that section provides an indication of such a belt condition. That measurement can be used for comparisons to actual measurements on belts in service to discern a condition of the belt.

The correlating data provides information to compute a figure of merit or a belt condition index. Once a threshold figure is determined for a given belt configuration, that information can be used in the field by elevator technicians to determine what a belt's current condition is and to make a decision whether replacement may be necessary.

In one example the belt condition index is based on a density of breaks in the element 38 (i.e., a number of breaks within a certain length of belt).

Devices that utilize the advances of this invention preferably are programmed to provide a technician or mechanic with an output indicating a condition of the belt assembly so that determinations can be made in the field regarding belt condition to facilitate decisions regarding maintenance or replacement.

Because such magnetic detection techniques are already used for steel cord belt inspection, this provides an advantage for this invention to be accommodated by current inspection machinery or devices.

The preceding description is exemplary rather than limiting in nature. Variations and modifications to the disclosed embodiments may become apparent to those skilled in the art that do not necessarily depart from the essence of this invention. The scope of legal protection given to this invention can only be determined by studying the following claims.

We claim:

1. A load bearing assembly for use in an elevator system, comprising:

a plurality of non-ferromagnetic fibers wound in a generally helical arrangement and arranged into at least one cord; and at least one ferromagnetic element that is wound with the non-ferromagnetic fibers and is part of the cord such that a physical characteristic of the ferromagnetic element changes responsive to strain on at least some of the non-ferromagnetic fibers and thereby provides an indication of a condition of the assembly.

2. The assembly of claim 1, wherein the ferromagnetic element comprises a wire.

3. The assembly of claim 2, including a polymer coating on the wire.

4. The assembly of claim 1, including a plurality of cords of the non-ferromagnetic fibers and including a corresponding plurality of ferromagnetic elements with each ferromagnetic element associated with a respective one of the cords.

5. The assembly of claim 4, wherein each ferromagnetic element comprises a steel wire.

6. The assembly of claim 1, wherein the ferromagnetic element breaks responsive to the strain.

7. A method of assembling a load bearing assembly for use in an elevator system, comprising:

winding a plurality of non-ferromagnetic fibers in a generally helical arrangement to form at least one cord; and winding a ferromagnetic element with the non-ferromagnetic fibers to be part of the cord such that a physical characteristic of the ferromagnetic element changes responsive to strain on at least some of the non-ferromagnetic fibers and thereby provides an indication of a condition of the assembly.

8. The method of claim 7, including forming a plurality of cords of non-ferromagnetic fibers and arranging a ferromagnetic element relative to each of the cords whereby each ferromagnetic element provides an indication of the condition of each cord, respectively.

9. The method of claim 8, wherein the ferromagnetic element comprises a wire.

10. A method of determining a condition of a load bearing assembly that has a plurality of non-ferromagnetic fibers arranged into at least one cord, comprising the steps of:

arranging a ferromagnetic element in a selected relationship with the cord such that a physical characteristic of the ferromagnetic element changes responsive to strain on at least some of the non-ferromagnetic fibers;

determining a number of changes in the physical condition of the ferromagnetic element along a length of the assembly; and determining a condition of at least some of the non-ferromagnetic fibers using the determined number of changes.

11. The method of claim 10, including determining a number of breaks in the ferromagnetic element.

12. The method of claim 10, including predetermining a belt condition index and determining a relationship between the detected number of breaks and the belt condition index.

13. The method of claim 12, wherein the belt condition index is based upon a number of breaks in the ferromagnetic element within a selected portion of the length of the assembly under determined strain conditions.

14. The method of claim 10, including arranging the ferromagnetic element to be part of the cord.

* * * * *